United States Patent [19]

Euker, Jr.

[11] Patent Number: 4,491,512

[45] Date of Patent: Jan. 1, 1985

[54] RECOVERY OF OIL FROM OIL-BEARING CARBONATES

[75] Inventor: Charles A. Euker, Jr., Houston, Tex.

[73] Assignee: Exxon Research & Engineering Co., Florham Park, N.J.

[21] Appl. No.: 562,951

[22] Filed: Dec. 19, 1983

[51] Int. Cl.[3] ..... C10G 1/04

[52] U.S. Cl. ..... 208/11 LE

[58] Field of Search ..... 208/11 LE, 8 LE

[56] References Cited

U.S. PATENT DOCUMENTS

| | | | |
|---|---|---|---|
| 1,820,917 | 9/1931 | Longford et al. | 208/11 LE |
| 2,173,842 | 12/1936 | Horner | 208/11 LE |
| 2,453,060 | 10/1948 | Bauer et al. | 208/11 LE |
| 2,825,677 | 3/1958 | Coulson | 208/11 LE |

*Primary Examiner*—Delbert E. Gantz
*Assistant Examiner*—A. Pal
*Attorney, Agent, or Firm*—Yale S. Finkle; Wayne Hoover

[57] ABSTRACT

Oil is recovered from oil-bearing rock composed primarily of carbonates by treating the oil-bearing rock with an aqueous solution of an alkali metal compound selected from the group consisting of alkali metal silicates, alkali metal phosphates, and alkali metal borates at a temperature above about 150° F. and then contacting the treated oil-bearing rock with hot water or a hot aqueous solution for a sufficient amount of time to extract the oil from the oil-bearing rock. Normally, the concentration of the alkali metal in the aqueous solution will be above about 0.5 molar and an organic solvent such as toluene, xylene or cyclohexane will be present in the treatment step. The oil-bearing rock will normally be an oil-bearing limestone containing a high viscosity oil which cannot be recovered using conventional hot water extraction techniques.

19 Claims, 1 Drawing Figure

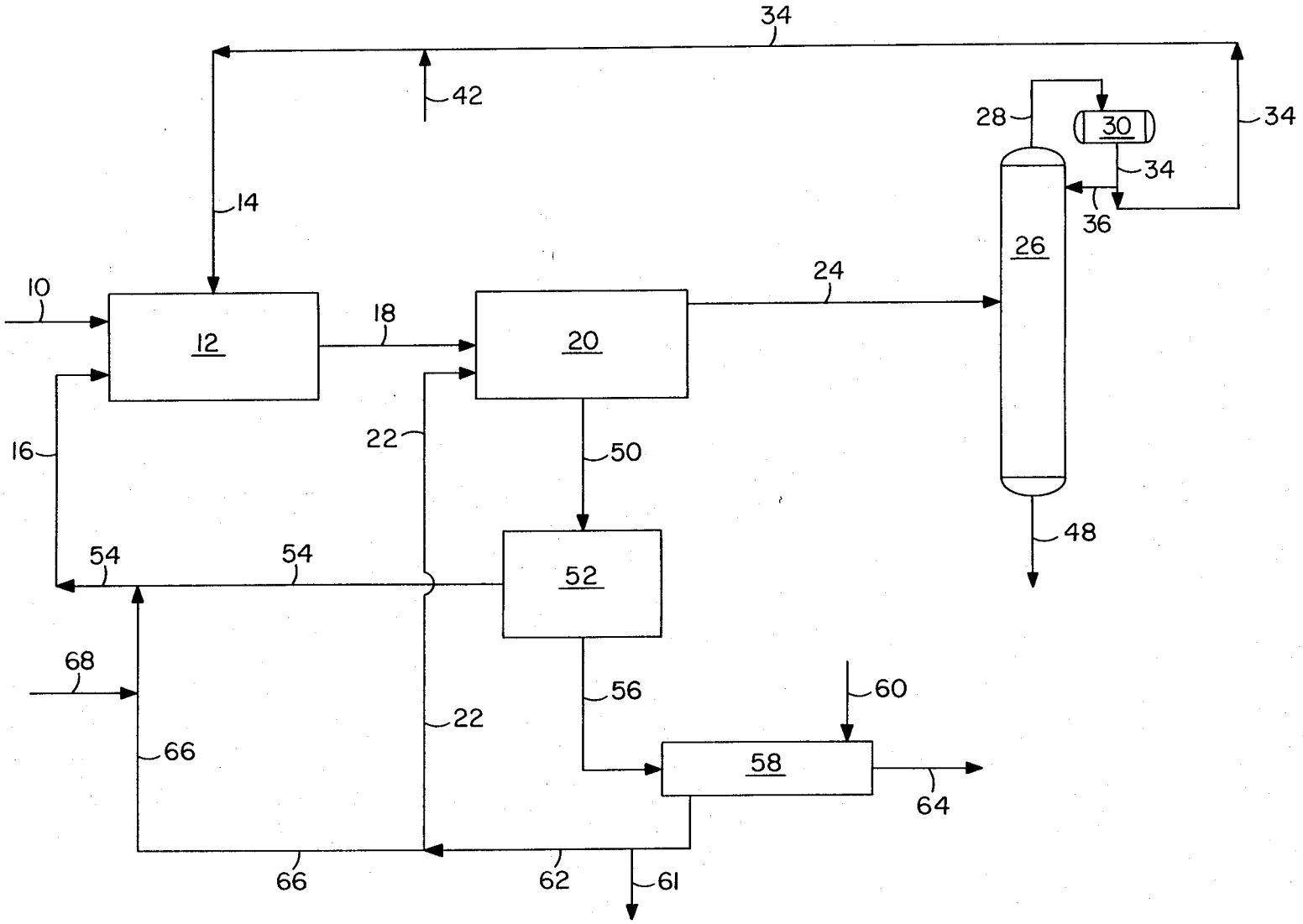
34
34
30
36
26
48
28
24
34
60
64
58
20
50
52
56
61
62
42
22
22
18
54
66
14
12
66
54
68
10
16

RECOVERY OF OIL FROM OIL-BEARING CARBONATES

BACKGROUND OF THE INVENTION

This invention relates to the recovery of oil from limestone, dolomite and other oil-bearing rock composed primarily of carbonates, and is particularly concerned with an extraction process which permits the recovery of oil in substantial quantities.

A large amount of oil exists today in the United States trapped in deposits of limestone and other carbonates located in Southwest Texas. The oil exists in the form of a high viscosity liquid at ambient conditions. As supplies of conventional petroleum are depleted, it will become desirable to recover liquid hydrocarbons from these oil-bearing deposits. It has been suggested that conventional methods of in-situ steam stimulation used in the past with success in recovering oil from tight formations of sand be applied in an attempt to recover heavy oil from limestone deposits. Such methods normally include drilling a series of several boreholes into the formation around a central borehole and introducing high pressure steam into the central borehole. The heat from the steam moves by conduction and convection outward from the central borehole decreasing the viscosity of the trapped oil and forcing it toward the other boreholes from which it is eventually recovered. Attempts to apply such methods to recovering the high viscosity, heavy oils from limestone deposits in Southwest Texas, however, have proven ineffective evidently because the deposits are too shallow to retain high pressure steam which in turn limits the temperature obtainable in the deposit to below that required for good oil production.

In addition to attempting to recover the oil by in-situ steam stimulation, it has been suggested that the oil-bearing limestone be mined and then subjected to pyrolysis in an above-ground retort thereby recovering the oil in a process similar to that used to recover liquid hydrocarbons from oil shale. Such pyrolysis processes normally involve heating the oil-bearing limestone to a temperature between about 700° F. and 900° F. in order to crack and volatilize the oil thereby forcing it out of the interstices of the limestone. Although such a process works effectively, it has some major disadvantages. The primary disadvantages are that the process involves the use of substantial amounts of energy to heat the large volume of limestone rock to high temperatures in order to produce a significant yield of liquids, and that a substantial amount (about 40 wt%) of the oil initially present on the limestone is converted into coke and gas by the high pyrolysis temperatures.

SUMMARY OF THE INVENTION

The present invention provides either an above-ground or subterranean process which permits the substantial recovery of oil from limestone, dolomite and other oil-bearing rock composed primarily of carbonates, which at least in part alleviates the difficulties described above. In accordance with the invention, it has now been found that substantial quantities of oil can be recovered from oil-bearing rock composed primarily of carbonates without the need for utilizing large quantities of heat by treating the oil-bearing rock with an aqueous solution of an alkali metal compound selected from the group consisting of alkali metal silicates, alkali metal phosphates and alkali metal borates at a temperature above about 150° F. The treated oil-bearing rock is then contacted with hot water or a hot aqueous solution, either subsequently or simultaneously with the treatment step, for a sufficient amount of time to extract the oil from the treated rock. The extracted oil is then recovered as product. Normally, an organic solvent in which the oil is soluble will be present during the treatment step in order to lower the viscosity of the oil so that it can be extracted more easily from the rock. The concentration of the alkali metal compound in the aqueous solution used in the treatment step will normally be above about 0.5 molar and will preferably range between about 0.5 molar and about 2.0 molar. Sodium silicate is the preferred alkali metal compound for use in the treatment step. Normally, the oil-bearing rock fed to the process will be limestone from the southwest area of Texas.

The process of the invention is based at least in part upon the discovery that the hot water extraction process that is proposed for recovering heavy oil from Athabasca tar sands in Canada, which are composed of a substrate consisting primarily of quartz or sand, cannot be used to recover similar heavy oil from a carbonate substrate. It has been found, however, that when oil-bearing rock composed substantially of a calcium carbonate substrate is treated with a relatively concentrated aqueous solution of sodium silicate, hot water will be effective in displacing the oil. It is believed that the sodium silicate reacts with the calcium carbonate surface to create an insoluble, hydrophilic calcium silicate surface that is more hydrophilic than the original carbonate substrate. This permits the physically adsorbed oil to be displaced from the calcium silicate surface by the water.

It will be understood that oil shale and tar sands having a predominantly quartz substrate are not within the scope of the substances that can be used as a feed material in the process of the invention. Oil cannot be recovered from run-of-mine oil shale using the process of the invention and oil can be recovered from tar sands having a quartz substrate with conventional hot water extraction techniques instead of having to utilize the process of the invention. The normal feed material to the process of the invention is an oil-bearing rock in which the inorganic portion or substrate is composed primarily of limestone, dolomite or other carbonate and the organic portion is asphaltic in nature and soluble in conventional organic solvents.

The process of the invention provides an above-ground or subterranean method for recovering oil from oil-bearing carbonate rock which is relatively simple and does not require the use of large amounts of energy. Thus, the process of the invention may provide a method of producing petroleum liquids from a domestic resource at a cost competitive with the cost of imported petroleum.

BRIEF DESCRIPTION OF THE DRAWING

The drawing is a schematic flow diagram of a process for recovering oil from oil-bearing rock carried out in accordance with the invention.

DESCRIPTION OF THE PREFERRED EMBODIMENTS

In the process depicted in the drawing, run-of-mine, oil-bearing rock that has been crushed to a top size from about ¼ inch to about ½ inch is passed through line 10 into conditioning zone 12 where the particles are mixed with an organic solvent introduced into the conditioning zone through line 14 and an aqueous solution containing an alkali metal compound selected from the group consisting of alkali metal silicates, alkali metal phosphates and alkali metal borates introduced into the conditioning zone via line 16. The oil-bearing rock is treated in conditioning zone 12 with the solvent and the aqueous solution of alkali metal compound at a temperature above about 150° F., preferably at a temperature between about 150° F. and about 250° F., most preferably at a temperature between about 200° F. and about 215° F. and at a pressure between about 0 psig and about 50 psig, preferably at about atmospheric pressure. The residence time of the oil-bearing rock in the conditioning zone will normally range between about 5 minutes and about 120 minutes, preferably between about 15 minutes and about 60 minutes. Normally, a sufficient amount of organic solvent is introduced into the conditioning zone through line 14 such that the mixture in the conditioning zone contains between about 5 wt % and about 20 wt % solvent based on the weight of the oil-bearing rock present. Likewise, a sufficient amount of the aqueous solution containing the alkali metal compound is introduced into the zone through line 16 such that the mixture in the zone contains between about 10 wt % and about 40 wt % aqueous solution based on the weight of the oil-bearing rock present.

The oil-bearing rock used as the feed material to conditioning zone 12 may be any oil-bearing rock composed primarily of a carbonate substrate. Examples of such rock include oil-bearing limestone, dolomite and magnesium carbonate. Normally, the inorganic portion of the rock will contain above about 80 wt % carbonates. In general, the oil present in the rock will be a high viscosity oil which is asphaltic in nature and soluble in conventional organic solvents. The viscosity of the oil will normally be greater than about 100 poise and will therefore be greater than the viscosity of oils that are found in subterranean deposits or reservoirs and serve as conventional feeds to petroleum refineries.

The organic solvent introduced into the conditioning zone 12 through line 14 will normally be any hydrocarbon solvent which will dissolve the oil present in the oil-bearing rock fed to the conditioning zone. The organic solvent may be an aromatic naphtha such as toluene, xylene and the like as well as cyclohexane or a chlorinated hydrocarbon such as methylene chloride. It may also be a solvent which is process derived by hydrotreating the oil extracted from the feed material during the process of the invention. If desired, the solvent may be a mixture of one or more materials.

The aqueous solution of alkali metal compound introduced into the conditioning zone 12 through line 16 will normally contain an alkali metal silicate, an alkali metal phosphate or an alkali metal borate in a concentration greater than about 0.5 molar. Preferably, the concentration of the alkali metal compound will range between about 0.5 molar and about 2.0 molar, most preferably between about 0.8 molar and about 1.0 molar. Examples of alkali metal phosphates and alkali metal borates that may be used as the alkali metal compound include sodium phosphate, sodium borate, potassium phosphate and potassium borate. Normally, the alkali metal compound will be an alkali metal silicate, preferably a sodium silicate with a $SiO_2/Na_2O$ ratio of 1.0 or less such as sodium metasilicate ($Na_2SiO_3$) or sodium orthosilicate ($Na_4SiO_4$). A sufficient amount of the alkali metal compound will be present in the aqueous solution such that the pH in the conditioning zone will range between about 12 and about 15, preferably between about 13 and about 14.

It has been proposed in the past to use hot water with or without a solvent to extract heavy oils from tar sands such as the Athabasca tar sands found in Canada. These tar sands are composed of a substrate containing primarily quartz or sand. It has been found that this hot water extraction process is not effective for removing heavy oil from a rock in which the substrate is primarily carbonates such as is the case with limestone and dolomite. It has now been found, however, that the oil can be displaced from the oil-bearing carbonate rock if a relatively concentrated solution of an alkali metal compound selected from the group consisting of alkali metal phosphates, alkali metal borates, and alkali metal silicates is used to condition the oil-bearing rock prior to the extraction step. If the oil is of high viscosity, normally above about 1000 poise et 100° F., it will normally be necessary to use an organic solvent with the alkali metal solution in the conditioning step. Such a solvent is normally not necessary when treating a carbonate rock containing a relatively low viscosity oil.

Referring again to the drawing, the mixture of oil-bearing rock, organic solvent and aqueous solution of alkali metal compound present in conditioning zone 12 will normally be the consistency of a paste or thick slurry and therefore the conditioning zone may be a screw conveyor, a tumbler, a rotary kiln or some similar contacting device. During the conditioning step, it is believed that the alkali metal phosphate, borate or silicate present in the aqueous solution reacts with the exposed rock surface to create an insoluble, hydrophilic borate, phosphate or silicate surface. This surface is more hydrophilic than the rock and this permits the physically adsorbed oil to be displaced from the surface by the water. Water would be ineffective in displacing the oil from the untreated rock surface. The organic solvent lowers the viscosity of the oil thereby allowing it to exit the interstices of the rock more easily. Assuming that an alkali metal silicate is used in the aqueous solution and limestone is the oil-bearing rock, two possible reactions of the silicate with the limestone are as follows:

$$CaCO_3 + SiO_3^{=} \rightarrow CaSiO_3 + CO_3^{=} \quad (1)$$

$$CaCO_3 + 2SiO_3^{=} + H_2O \rightarrow CaSi_2O_5 + CO_3^{=} + 2OH^- \quad (2)$$

Calcium sulfate impurities in the limestone will react rapidly with the alkali metal silicate solution and their presence represents a potential silicate loss. The reaction is believed to occur as follows:

$$CaSO_4 + 2SiO_3^{=} + H_2O \rightarrow CaSi_2O_5 + SO_4^{=} + 2OH^- \quad (3)$$

As can be seen, alkali metal carbonates and sulfates are produced in the conditioning step.

After the conditioning in zone 12 has been completed, the effluent from the zone, which is composed of oil-bearing rock, organic solvent, and an aqueous solution containing an alkali metal silicate, borate or phosphate along with an alkali metal carbonate and sulfate, is passed through line 18 to extraction zone 20. Here the effluent is mixed and contacted with water or an aqueous solution recovered in the process as described hereinafter. In general, sufficient amounts of water or aqueous solution are introduced into the extraction zone such that the mixture in the zone contains between about 50 wt % and about 150 wt % aqueous solution based upon the weight of the oil-bearing rock present.

The extraction zone is designed such that there can be intimate contact obtained between the oil-bearing rock and the liquids present in the zone. A Clark extractor is an example of a suitable extraction device that can be used. During the extraction step, the materials in the extraction zone are subjected to temperatures ranging between about 100° F. and about 200° F., normally between about 150° F. and about 200° F., at atmospheric pressure for a sufficient period of time such that the oil in the oil-bearing rock is displaced from the interstices of the rock into the liquid phase present in the extraction zone. Because the oil-bearing rock has been previously conditioned by treating it with an aqueous solution of an alkali metal compound and an organic solvent in conditioning zone 12, the oil is easily displaced and extracted from the rock.

As the oil is displaced from the rock in extraction zone 20, the resulting organic phase floats to the top of the extraction zone where it is withdrawn through line 24 and passed to fractionator 26. Here the organic solvent is separated from the extracted oil. The solvent, which will generally have a boiling point lower than the majority of the constituents comprising the extracted oil, is removed overhead of the fractionator through line 28 along with lower boiling constituents of the extracted oil. The fractionator overhead is cooled and passed to distillate drum 30 where liquids are collected. The liquid, which will contain solvent and lighter constituents of the extracted oil, is withdrawn from the distillate drum 30 through line 34. A portion of this liquid may be returned as reflux to the upper portion of the fractionator through line 36. The remaining liquid is recycled through lines 34 and 14 to conditioning zone 12. Any solvent makeup required may be added to line 34 through line 42. A bottoms fraction composed primarily of hydrocarbons boiling above about 700° F. and fine rock particles is withdrawn from the fractionator through line 48 and may be further processed to produce desired products.

Although as described above and shown in the drawing, the organic solvent is introduced into conditioning zone 12, it may under certain circumstances be introduced into extraction zone 20 instead without significant decrease in yield of extracted oil. This is normally the case if the size of the oil-bearing rock fed to the process is relatively small. When larger size particles are utilized, introducing the organic solvent into the extraction zone will significantly reduce the overall yield of extracted oil.

After the organic layer containing extracted oil and solvent is removed from the top of extraction zone 20, the aqueous solution along with oil-depleted rock particles are withdrawn from the extraction zone through line 50 and passed to separation zone 52. Here the aqueous solution, which contains alkali metal silicates, borates or phosphates and alkali metal carbonates and sulfates produced in conditioning zone 12, is separated from the oil-depleted rock particles. The separated aqueous solution is removed from the separation zone through line 54 and recycled to the conditioning zone 12 through line 16. The oil-depleted rock particles are removed from the separation zone through line 56 and passed to alkali metal recovery zone 58. Separation zone 52 may be a hydroclone, filter, centrifuge, gravity settler or similar liquid-solids separation device.

The oil-depleted rock particles removed from separation zone 52 through line 56 will contain entrained liquid containing the alkali metal compound which was present in the aqueous solution introduced into conditioning 12 through line 16. In order for the process of the invention to be economical, it is normally necessary to recover these residual amounts of alkali metal constituents. The oil-depleted particles are therefore passed through line 56 into alkali metal recovery unit 58. The recovery unit will normally comprise a multistage countercurrent leaching system in which the oil-depleted particles containing the entrained alkali metal solution are countercurrently contacted with water introduced through line 60. An aqueous solution of alkali metal compounds is withdrawn from the recovery unit through line 62 and oil-depleted rock particles from which alkali metal constituents have been leached are withdrawn through line 64. The oil-depleted rock particles exiting recovery unit 58 may be disposed of as landfill or used for other purposes. The alkali metal solution withdrawn from recovery unit 58 through line 62 will contain the alkali metal compound which is present in the aqueous solution introduced into conditioning zone 12 through line 16 along with alkali metal carbonates and alkali metal sulfates formed in the conditioning zone by the reaction of the alkali metal compound in the aqueous solution with the carbonate substrate of the rock particles and calcium sulfate impurities. A portion of this solution, which will normally have a concentration of the alkali metal compound present in the aqueous solution in line 16 that ranges between about 0.5 and about 1.0 molar, is recycled to extraction zone 20 through line 22. Another portion of this solution is passed through line 66, combined with the aqueous solution in line 54 and recycled to conditioning zone 12 through line 16. The remaining portion of the solution is removed from line 62 through line 61 in order to purge alkali metal carbonates and sulfates from the process. Makeup alkali metal compound may be introduced into line 66 via line 68.

The nature and objects of the invention are further illustrated by the results of laboratory tests. The first series of tests illustrates that substantial amounts of a high viscosity oil can be extracted from an oil-bearing rock composed primarily of carbonates utilizing hot water or a hot aqueous solution if the oil-bearing rock is first treated with an aqueous solution containing sodium silicate in a concentration above about 0.5 molar. The second series of tests indicate that when a high viscosity oil is present in the oil-bearing rock, a small amount of organic solvent must also be present during the treatment or conditioning step.

In the first series of tests, about 1.6 grams of oil-bearing limestone from southwest Texas that had been crushed and screened between 30 and 50 mesh on the U.S. Sieve Series Scale was placed in a centrifuge tube and mixed with about 0.10 grams of toluene and about 3.2 grams of an aqueous solution having a preselected concentration of sodium silicate. The centrifuge tube was then placed in a constant temperature water bath where the limestone was pretreated or conditioned with the mixture of toluene and sodium silicate solution at 93° C. for 3 hours. After this pretreatment, the centrifuge tube was removed from the water bath and the mixture in the tube was combined with another 0.10 grams of toluene and a dilute aqueous solution of sodium silicate prepared by adding 2.5 grams of water to 2.5 grams of the sodium silicate solution which was originally used in the pretreatment step. The diluted mixture was then agitated with a spatual at about 150° F. in order to extract the oil from the limestone. A mixture of the extracted oil dissolved in toluene floated to the top of the aqueous phase in the centrifuge tube. Nitrogen was then blown over the floating material until a sufficient amount of the toluene evaporated from the mixture so that the organic layer floating on the aqueous phase was primarily the extracted oil. The sticky extracted oil was then removed from the tube with a spatula, placed on a watch glass and dried in a oven at 100° C. for 4 hours to remove all of the toluene. The remaining material on the watch glass consisted of a mixture of extracted oil and small particles of limestone and this material was weighed. In order to remove the extracted oil from the limestone fines, the mixture was combined with 80 milliliters of toluene in a centrifuge tube and subjected to centrifugation. The toluene dissolved the extracted oil from the limestone particles and the resultant solution was decanted from the limestone fines, which were again treated with 80 milliliters of toluene in the same manner. The mixture of toluene and extracted oil from each decantation was placed in a beaker, nitrogen was blown over the beaker to evaporate the toluene and the beaker was then placed in a vacuum oven to remove residual toluene. The extracted oil remaining after the toluene was removed was weighed as was the limestone residue. A sample of the original oil-bearing limestone was analyzed for oil content. Runs similar to those described above were also carried out except that the toluene was added in the extraction step only instead of in both the conditioning and extraction steps. In addition, two runs were carried out similar to the above-described runs except that the oil-bearing limestone utilized was crushed and screened to a size between 8 and 16 mesh on the U.S. Sieve Series Scale. The results of the above-described tests are set forth in Table 1 below.

TABLE 1*

EFFECT OF SODIUM SILICATE CONCENTRATION ON OIL RECOVERY

| Concentration of $Na_2SiO_3$ (Molar) | % Oil Recovery (Toluene in Pretreatment and Extraction Steps) | % Oil Recovery (Toluene in Extraction Step Only) |
|---|---|---|
| 0.05 | 8 | 6 |
| 0.10 | 13 | 5 |
| 0.20 | 39 | 24 |
| 0.50 | 78 | 61 |
| 0.75 | 80 | 73 |
| 1.00 | 80 | 76 |
| 1.00** | 75** | 39** |

*Unless otherwise indicated, data was obtained using 30-50 mesh oil-bearing limestone with pretreatment or conditioning step carried out at 200° F. for 3 hours
**8-16 mesh oil-bearing limestone As can be seen from Table 1, the percent recovery of oil from the oil-bearing limestone increases with increasing concentrations of sodium silicate in the aqueous solution used in the pretreatment or conditioning step. Substantial recovery of oil does not occur until the concentration of the sodium silicate exceeds about 0.5 molar. The data in the table also indicate that adding the toluene in the pretreatment and extraction steps as opposed to in the extraction step only results in slightly higher recoveries when the oil-bearing limestone used as feed is between 30 and 50 mesh in size. As the size of the oil-bearing limestone increases into the 8 by 16 mesh range, the amount of oil recovery is significantly reduced if the toluene is added only in the extraction step. As indicated in the table, only 39 percent of the oil is recovered when the toluene is added in the extraction step as compared to 75 percent when it is added in both the pretreatment and extraction steps. Clearly, the data indicate that it is preferable to have the toluene or other organic solvent present in the pretreatment or conditioning step unless the size of the oil-bearing limestone is relatively small.

The second series of tests was conducted in a similar manner as discussed in relation to the first series of tests except that 8 grams of oil-bearing limestone having a top size of 8 mesh on the U.S. Sieve Series Scale was mixed with 1.5 grams of a 1.0 molar aqueous solution of sodium silicate in the centrifuge tube and the pretreatment step was carried out for a length of 2 hours at a temperature of about 240° F. with preselected amounts of toluene added to the pretreatment step and no toluene added to the extraction step. Also, instead of using a constant temperature water bath in the pretreatment step, the centrifuge tube was placed in a tubing bomb so that it could be pressurized. The results of this series of tests are set forth below in Table 2.

TABLE 2*

EFFECT OF TOLUENE CONCENTRATION ON OIL RECOVERY

| Toluene Concentration (Wt % Based on Weight of Limestone) | % Oil Recovery |
|---|---|
| 0 | 0 |
| 2.6 | 77% |
| 4.9 | 85% |
| 7.3 | 88% |
| 10.1 | 92% |
| 12.3 | 92% |
| 15.0 | 93% |
| 20.0** | 95%** |

*Unless otherwise indicated, 2 hour pretreatment times were used
**1 hour pretreatment time It can be seen from Table 2 that only a small concentration of toluene is required in the pretreatment step to obtain oil recoveries of 77 percent or greater. The percent oil recovery can be increased to 93 percent by utilizing 15 wt % toluene. A recovery of 95 percent oil can be achieved by utilizing 90 wt % toluene and only 1 hour of pretreatment time. A pretreatment time of one hour may be sufficient to obtain high oil recoveries in all cases. The data in the table indicate that when no toluene is utilized no oil is recovered. The high viscosity of the oil found in the oil-bearing limestone utilized to conduct the tests, a viscosity above about 1000 poise at 100° F., makes it difficult for the water to displace the oil from the interstices of the rock without toluene or another organic solvent present to lower the viscosity. The toluene or other organic solvent would normally not be necessary for use in the process of the invention if the oil found in the oil-bearing rock fed to the process had lower viscosities, viscosities below about 100 poise at 100° F. The data in Table 2 also show that addition of solvent to the extraction step as was done in the first series of tests is not necessary to achieve high recoveries of oil.

It will be apparent from the foregoing that the process of the invention provides a method for recovering hydrocarbon liquids from oil-bearing rock without the need to utilize relatively high temperatures. As a result, it is possible to significantly reduce the amount of heat that is normally required to produce such liquids in conventional processes and to increase the oil yield to between 90 and 95 percent of the oil initially present in the oil-bearing rock thereby lowering the overall cost of the liquids produced.

I claim:

1. A process for recovering an oil from oil-bearing rock composed primarily of carbonates which comprises:

(a) treating said oil-bearing rock with an aqueous solution of an alkali metal compound selected from the group consisting of alkali metal silicates, alkali metal phosphates and alkali metal borates at a temperature above about 150° F., said aqueous solution having a concentration of said alkali metal compound above about 0.5 molar;

(b) contacting the treated oil-bearing rock from step (a) with hot water or a hot aqueous solution for a sufficient amount of time to extract said oil from said treated rock; and (c) recovering said oil extracted in step (b).

2. A process as defined by claim 1 wherein said oil-bearing rock is treated with said aqueous solution af alkali metal compound in the presence of an added organic solvent in which the oil in said oil-bearing rock is soluble.

3. A process as defined by claim 2 wherein said organic solvent comprises toluene or xylene.

4. A process as defined by claim 1 wherein said treated, oil-bearing rock from step (a) is contacted with hot water or a hot aqueous solution in the presence of an added organic solvent in which the oil in said oil-bearing rock is soluble.

5. A process as defined by claim 4 wherein said organic solvent comprises toluene or xylene.

6. A process as defined by claim 1 wherein said oil-bearing rock contains above about 80 wt % carbonates.

7. A process as defined by claim 1 wherein said oil-bearing rock comprises oil-bearing limestone.

8. A process as defined by claim 1 wherein said oil-bearing rock comprises oil-bearing dolomite.

9. A process as defined by claim 1 wherein the viscosity of said oil in said oil-bearing rock is greater than the viscosity of conventional petroleum oils normally found in subterranean deposits or reservoirs.

10. A process as defined by claim 1 wherein said alkali metal compound comprises an alkali metal silicate.

11. A process as defined by claim 10 wherein said alkali metal silicate comprises sodium silicate.

12. A process as defined by claim 1 wherein the concentration of said alkali metal in said aqueous solution ranges between about 0.5 molar and about 2.0 molar.

13. A process as defined by claim 1 wherein said oil-bearing rock is treated with said aqueous solution at a temperature between about 150° F. and about 250° F.

14. A process for recovering a high viscosity oil from oil-bearing limestone which comprises:

(a) treating said oil-bearing limestone with an aqueous solution having a concentration of an alkali metal silicate above about 0.5 molar in the presence of an added organic solvent in which the oil in said oil-bearing rock is soluble at a temperature between about 150° F. and about 250° F.;

(b) contacting the treated oil-bearing limestone from step (a) with hot water or a hot aqueous solution for a sufficient amount of time to extract said high viscosity oil from said treated limestone; and (c) recovering said high viscosity oil extracted in step (b).

15. A process as defined by claim 14 wherein said high viscosity oil comprises an oil having a viscosity greater than about 1000 poise at 100° F.

16. A process as defined by claim 14 wherein said alkali metal silicate comprises sodium silicate.

17. A process as defined by claim 14 wherein said organic solvent comprises toluene or xylene.

18. A process as defined by claim 14 wherein said hot aqueous solution utilized in step (b) comprises a dilute solution of the alkali metal silicate utilized in step (a).

19. A process for recovering a high viscosity oil from oil-bearing limestone which comprises:

(a) treating said oil-bearing limestone with an aqueous solution having a concentration of sodium silicate above about 0.5 molar in the presence of an organic solvent in which the oil in said oil-bearing limestone is soluble at a temperature between about 150° F. and about 250° F. in a treatment zone;

(b) passing said treated oil-bearing limestone to an extraction zone wherein said treated oil-bearing limestone is contacted with hot water or a hot aqueous solution for a sufficient amount of time to extract said high viscosity oil from said oil-bearing limestone thereby producing oil-depleted limestone;

(c) withdrawing the mixture of organic solvent and extracted high viscosity oil from said extraction zone;

(d) recovering said extracted high viscosity oil from said organic solvent as product;

(e) withdrawing a mixture of an aqueous solution and oil-depleted limestone from said extraction zone;

(f) separating said aqueous solution from said oil-depleted limestone and recycling said aqueous solution to said treatment zone;

(g) washing said oil-depleted limestone with water to recover residual sodium silicate from said oil-depleted limestone;

(h) recycling a portion of the aqueous solution recovered from washing said oil-depleted limestone to said extraction zone; and (i) recycling another portion of the aqueous solution recovered from washing said oil-bearing limestone to said treatment zone.

* * * * *